US005256184A

United States Patent [19]

Kosco et al.

[11] Patent Number: 5,256,184

[45] Date of Patent: Oct. 26, 1993

[54] MACHINABLE AND WEAR RESISTANT VALVE SEAT INSERT ALLOY

[75] Inventors: John C. Kosco, Saint Mary, Pa.; William Neumann, Lakewood, Ohio

[73] Assignee: TRW Inc., Lyndhurst, Ohio

[21] Appl. No.: 780,439

[22] Filed: Oct. 16, 1991

Related U.S. Application Data

[63] Continuation-in-part of Ser. No. 685,838, Apr. 15, 1991, abandoned.

[51] Int. Cl.[5] ..... B22F 9/00

[52] U.S. Cl. ..... 75/246; 75/243

[58] Field of Search ..... 75/243, 246; 419/11, 419/26, 58

[56] References Cited

U.S. PATENT DOCUMENTS

| | | | |
|---|---|---|---|
| 3,471,343 | 10/1969 | Koehler | 75/246 X |
| 3,802,852 | 4/1974 | Niimi et al. | 75/246 X |
| 3,806,325 | 4/1974 | Niimi et al. | 29/182.1 |
| 4,035,159 | 7/1977 | Hashimoto et al. | 75/246 |
| 4,080,205 | 3/1978 | Niimi et al. | 75/241 |
| 4,204,031 | 5/1980 | Takemura et al. | 428/539.5 |
| 4,233,073 | 11/1980 | Takemura | 75/243 |
| 4,505,988 | 3/1985 | Urano et al. | 428/569 |
| 4,599,110 | 7/1986 | Köhler et al. | 75/243 |
| 4,724,000 | 2/1988 | Larson et al. | 75/236 |
| 4,919,719 | 4/1990 | Abe et al. | 75/243 |
| 4,964,908 | 10/1990 | Greetham | 75/241 |
| 4,966,626 | 10/1990 | Fujiki et al. | 75/238 |
| 5,082,433 | 1/1992 | Leithner | 419/11 |
| 5,108,493 | 4/1992 | Causton | 75/255 |

*Primary Examiner*—Donald P. Walsh
*Assistant Examiner*—Ngoclan Mai
*Attorney, Agent, or Firm*—Tarolli, Sundheim & Covell

[57] ABSTRACT

A powder composition is suitable for making a valve seat insert having good machinability and high temperature wear resistance. The composition consists essentially of about 0.5%-5% nickel, about 1%-10% molybdenum, less than 0.1% copper, about 0.4%-1.2% carbon, the remainder being iron. The ratio of nickel to molybdenum is about 0.25:1 to 1:1. The nickel and molybdenum are preferably present as a blend of elemental nickel, elemental molybdenum, and a pre-alloyed powder in which nickel and molybdenum are pre-alloyed with iron.

9 Claims, 1 Drawing Sheet

100X

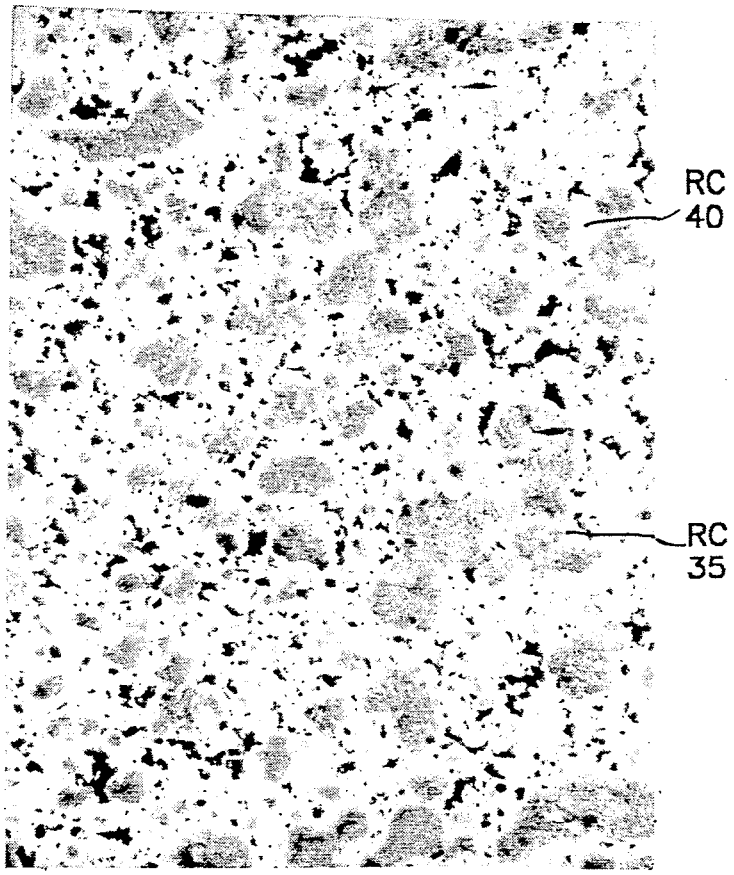
100X

MACHINABLE AND WEAR RESISTANT VALVE SEAT INSERT ALLOY

This is a continuation-in-part of co-pending application Ser. No. 07/685,838 filed on Apr. 15, 1991, now abandoned.

BACKGROUND OF THE INVENTION

1. Technical Field

The present invention relates to a powder metal composition for producing wear resistant and easily machinable valve seat inserts for internal combustion engines, and to the valve seat inserts produced from the composition.

2. Description of the Prior Art

Most internal combustion engine valve seat inserts are made by a powder metal process. A powder metal process is suitable for valve seat insert production because the process is capable of forming the valve seat insert to near its final shape. Some machining is required, but the powder metal process reduces machining requirements, making the production of the valve seat inserts economical.

Powder metal compositions for producing valve seat inserts having both good wear resistance and machinability are known. However, such compositions generally require a high percentage of alloying, or costly processing, both requirements adding to the cost of the inserts.

U.S. Pat. No. 3,806,325 discloses an iron based alloy for a valve seat ring for an internal combustion engine. One alloy disclosed in the patent is obtained by blending iron powder with about 0.25 to 8 weight percent molybdenum, 0.1 to 1 weight percent carbon, and 1 to 20 weight percent nickel and/or copper. The powder mixture is formed and sintered to a density of about 6.7 grams per $cm^3$ and then is infiltrated with an infiltrating material such as lead.

SUMMARY OF THE INVENTION

The present invention resides in a novel powder composition suitable for making valve seat inserts having good machinability and high temperature wear resistance. The powder composition consists essentially of, on a weight basis, about 0.5%-5% nickel, about 1%-10% molybdenum, less than 0.1% copper, and about 0.4%-1.2% carbon, the remainder being iron. The ratio of nickel to molybdenum by weight is in the range of about 0.25:1 to about 1:1. The nickel and molybdenum preferably are present in the composition as a blend of (i) pre-alloyed iron powder containing nickel and/or molybdenum, (ii) elemental nickel powder, and (iii) elemental molybdenum powder. Preferably, the pre-alloyed iron powder contains at least about 0.50% by weight nickel and/or molybdenum, based on the weight of the iron alloy with which the elemental nickel powder and the elemental molybdenum powder are blended.

The present invention also resides in a compacted and sintered valve seat insert made from the above composition. The insert has a density of at least about 6.8 grams per $cm^3$, preferably at least about 7 grams per $cm^3$.

BRIEF DESCRIPTION OF THE FIGURE

Further features of the present invention will become apparent to those skilled in the art to which the present invention relates from reading the following specification with reference to the accompanying FIGURE, in which the FIGURE is a view of a sectioned part prepared in accordance with the present invention obtained using a light microscope at 100 magnification.

DESCRIPTION OF A PREFERRED EMBODIMENT

In the following description, all percentages and ratios are percentages and ratios by weight, unless otherwise specified. Percentages are based on the total composition weight, unless otherwise specified.

The powder metal composition of the present invention consists essentially of, on a weight basis:

0.5%-5% and preferably 1%-3% nickel (Ni);

1%-10% and preferably 1.5%-5% molybdenum (Mo);

less than 0.1% copper (Cu);

0.4%-1.2% and preferably 0.5%-1% carbon (C); remainder iron (Fe).

The weight ratio of nickel to molybdenum is in the range of about 0.25:1 to 1:1. A portion of the nickel and a portion of the molybdenum preferably are pre-alloyed with the iron, preferably by atomization. The balance of the nickel and molybdenum in the composition are elemental nickel powder and elemental molybdenum powder which are added to the pre-alloyed powder.

The nickel powder should compose at least 0.5% by weight of the composition. At less than 0.5% nickel, the sintered compact of the present invention has insufficient strength and hardness. Also, a nickel content of at least about 0.5% helps reduce dimensional change when sintered. The nickel should compose less than 5% of the composition. If more than 5% nickel is used, the sintered compact is too difficult to machine. At more than about 2.5% nickel, resistance to machining increases. An optimum range for hardness and machinability is about 1%-3% nickel.

The molybdenum should compose 1%-10% by weight of the composition. Molybdenum significantly improves the wear properties of the sintered compact, particularly at temperatures of 400°-900° F. A preferred amount of molybdenum is about 1.5%-5%. Molybdenum additions are expensive. Amounts of molybdenum above about 5% do not improve the wear properties at a sufficient rate to justify the additional cost. Below about 1% molybdenum, the wear properties drop rapidly. A preferred lower limit for molybdenum is about 1.5%.

The carbon provides hardness and wear resistance. At percentages above about 1% by weight, the hardness increases, but machinability is adversely affected. A preferred upper limit for carbon is 0.85%. At percentages below about 0.4% carbon, the sintered compact has insufficient hardness and wear resistance. A preferred lower limit for carbon is 0.6%.

An optimum relationship between nickel and molybdenum exists. At nickel/molybdenum ratios of one or more, machinability decreases. At nickel/molybdenum weight ratios less than one, down to about 0.25:1, machining improves dramatically, without detrimentally affecting wear properties. A preferred ratio of nickel to molybdenum is about 0.75:1 to 0.3:1.

The presence of copper in the nickel/molybdenum/carbon systems of the present invention is detrimental to both wear and machinability. The copper level is thus maintained in the compositions at less than 0.1% by weight.

The nickel/molybdenum/carbon alloys of this invention are prepared by mixing fine, high purity elemental nickel powder and fine, high purity elemental molybdenum powder with a pre-alloyed iron powder and graphite. The pre-alloyed iron powder contains nickel and/or molybdenum, preferably about 0.5%-4% by weight total alloy based on the weight of the iron powder. Preferably the pre-alloyed iron powder contains about 0.25%-2% by weight of each element, nickel and molybdenum, based on the weight of the iron powder. The pre-alloyed iron powder is an atomized powder having a particle size of about −80 mesh. Both the nickel and molybdenum powders are very fine, typically less than 10 microns average particle size. A preferred carbon is graphite having a particle size of about −325 mesh. Typically, a flake graphite is used.

The ingredients of the composition are mixed with a lubricant suitable for compacting. The types of lubricants for compacting, and their amounts are well known, and not a part of the present invention. In the following Examples, the ingredients were compacted using an atomized wax sold by Glyco Chemicals, Inc. under the trademark "ACRAWAX C". Typically, about 0.6% "Acrawax C," based on the powder composition weight, was used.

Compacting is carried out by placing the powders in a die and subjecting the powders to compacting pressures. Typically, the powders are subjected to a compacting pressure on the order of 40–50 tons per square inch (tsi).

Following compacting, the compacted parts are sintered. Normally, sintering is carried out at a temperature of about 2,100° to about 2,150° F., in a nitrogen atmosphere. The conditions of compacting and sintering, in the present invention, are selected to obtain a compacted part having a density of at least about 6.8 grams $cm^3$, preferably at least about 7 grams $cm^3$. Sintering is carried out for about 20 to about 60 minutes. The compacted parts after sintering may be tempered to improve machinability. Tempering typically is carried out at about 600°-1,000° F., preferably about 800° F.

In the following Examples, the column headings, in the Tables, have the following meanings:

"Ni" means nickel;

"Mo" means molybdenum;

"Ni:Mo" means nickel:molybdenum ratio;

"TC" means total carbon;

"SINT" means sintering conditions. By way of example, the designation 2135N means that the sintering was carried out at 2,135° F. under a nitrogen atmosphere.

"HTI" means tempering conditions. For instance, "800N" means that the tempering was carried out under a nitrogen atmosphere at 800° F. The letters "V" and "A" mean in vacuum and in air, respectively.

"MR" means modulus of rupture. The modulus of rupture was obtained, following ASTM spec B528-83a, by subjecting a compacted and sintered part to a three point break test. Modulus of rupture measurements indicate the room temperature mechanical strength of the sintered part. From experience, values should exceed 70 ksi, and preferably 90 ksi to prevent mechanical breakage of the parts during handling, assembly, or use.

"HARD RB" means Rockwell B hardness. Suitable valve seat inserts should have Rockwell B hardness values of about 80–115.

"W500" means wear, in $mm^3$ obtained in a wear test, at 500° F. The values given are an indication of the ability of the part to resist wear at high temperature. The wear test was carried out on a dry-friction "flat-on-round" type tester of the type used to measure adhesive wear of materials. A specimen is inserted into the tester. The specimen can be either a rectangular bar or a round insert which has a flat spot ground on the OD. This specimen is positioned to run against a 0.750 diameter shaft of a standard of 21-2N valve alloy. A load of 37 pounds per inch of contact length is applied to the specimen and the run time is 30 minutes at 2,500 rpm. Typically, the test is carried out in a furnace maintaining the specimen at a temperature in the range of about 500°-900° F. The designation "W500" indicates a 500° F. test. After the test is completed, the scar width is measured. Knowing the shaft diameter, scar width and scar length, it is then possible to calculate the volume of material worn away during the test. Preferably the wear is less than about 5 $mm^3$, more preferably less than 4 $mm^3$.

"Compressive Yield (Y700)" means the yield strength obtained at 700° F., using the procedure of ASTM spec. E9-87. A valve seat insert should not deform plastically at engine temperatures. The yield strength is the amount of force required to compression deform the part at a given temperature. High yield strengths at high temperatures are required. Values are given in thousands of pounds per square inch (ksi), obtained at the 1% offset value from ASTM E9-87. For instance, the value 96 means that 96 ksi was required to compression deform the part at 700° F. at 1% offset. A valve seat insert should have a yield strength of at least 75 ksi, preferably at least 80 ksi.

"Flank Wear" is an indication of the machinability of the part. The number obtained indicates the wear on a cutting tool when the tool is used to machine an insert under a standard set of conditions. A larger number indicates that the part is less machinable. The tests are carried out by placing samples of ring shaped valve seat blanks on a lathe. Tests typically were carried out with samples having the following dimensions: 1.530 OD by 1.220 ID by 0.300 height, but samples of other dimensions can be used by appropriately adjusting cutting speed to obtain the same surface foot per minute speed. A face cut is made by cutting from OD to ID to reduce the height of the part. This cut is made using a lathe. Cutting conditions are:

| | |
|---|---|
| Cutting tool | Kennametal SPG322, Grade KC730 |
| Cutting Speed | 450 rpm |
| Depth of Cut | 0.025 inch |
| Feed Rate | 0.0015 inch/rev |
| Number of Passes | To remove approximately 0.3 cubic inches, using 15 passes |

After cutting, the cutting tool is examined with a filar microscope. Flank wear is determined by measuring the length of the flank wear scar. Units of flank wear are inches of flat of the cutting tool per cubic inches of metal removed from the sample. A larger length of flat on the cutting tool indicates that the part was more difficult to machine. Values under 0.05 $in/in^3$, preferably under 0.025 $in/in^3$, indicate acceptable machinability. Values under 0.012 $in/in^3$ indicate excellent machinability.

"NM" in the Tables indicates that no measurement was taken or that the data was inapplicable.

the ratio in the composition of the present invention. Samples were prepared following the procedure of Example 1. The following data was obtained:

TABLE 1

| | Effect of C Addition in Ni—Mo-Steel Composites | | | | | | | | Comp | Flank |
|---|---|---|---|---|---|---|---|---|---|---|
| Sample | Ni | Mo | Ni/Mo Ratio | TC % C | Sint °F./Atm | MR ksi | Hard RB | W500 $mm^3$ | Yield Y700 ksi | Wear $in/in^3$ |
| 1 | 2.0 | 3.1 | 0.65 | 0.60 | 2135N | 174 | 96 | 4.9 | NM | .007 |
| 2 | 2.0 | 3.1 | 0.65 | 0.85 | 2135N | NM | 99 | 5.4 | NM | .030 |
| 3 | 4.5 | 2.6 | 1.73 | 0.45 | 2142N | 199 | 98 | 4.9 | 96.0 | .087 |
| 4 | 4.5 | 2.6 | 1.73 | 0.85 | 2142N | 116 | 109 | 3.6 | 96.9 | .227 |

TABLE 2

| | Effect of Ni:Mo Ratios in Ni—Mo-Steel Composites | | | | | | | | Comp | Flank |
|---|---|---|---|---|---|---|---|---|---|---|
| Sample | Ni | Mo | Ni/Mo Ratio | % C TC | Sint °F./Atm | MR ksi | Hard RB | W500 $mm^3$ | Yield Y700 ksi | Wear $in/in^3$ |
| 5 | 1.5 | 3.6 | 0.4 | 0.65 | 2135N | 172 | 94 | 4.9 | NM | .013 |
| 6 | 1.5 | 2.6 | 0.58 | 0.65 | 2135N | 168 | 96 | 4.9 | NM | .013 |
| 7 | 4.5 | 4.6 | 0.98 | 0.45 | 2142N | 174 | 101 | 3.6 | 1.018 | .057 |
| 8 | 2.5 | 2.6 | 0.96 | 0.45 | 2142N | 172 | 97 | 6.5 | 87.3 | .063 |
| 9 | 4.5 | 2.6 | 1.73 | 0.45 | 2142N | 199 | 98 | 4.9 | 96.0 | .087 |

EXAMPLE 1

To illustrate the effect of carbon additions, powders were prepared having the compositions given in the following Table 1. The compositions all had less than 0.1% copper. The powders were compacted at 40–50 tons per square inch and sintered to obtain a density of about 7 grams per cubic centimeter. None of the samples were tempered.

Samples 1 and 2 are within the scope of the present invention. Samples 3 and 4 had higher percentages of nickel and molybdenum than samples 1 and 2 and Ni:Mo ratios of 1.73, which is outside the scope of the present invention. Comparing samples 3 and 4, wear at 500° ("W500") decreased with increased carbon indicating better ability to resist wear with more carbon. Better values were also obtained for hardness (RB) and compressive yield ("Comp Yield"). However, the flank wear (last column) substantially increased from 0.087 to 0.227 indicating more difficult machining.

Similarly, in samples 1 and 2, flank wear increased with carbon content indicating more difficult machining. Only slightly higher hardness and wear values were obtained. Sample 1 had a flank wear of 0.007 $in/in^3$ within the limit of less than 0.012 $in/in^3$ for this measurement, indicating excellent machinability. It is interesting to note that the lower alloy compositions (samples 1 and 2) gave almost as good wear ("W500") and hardness ("Hard RB") values as the more alloyed compositions (samples 3 and 4).

EXAMPLE 2

The purpose of this Example is to illustrate the effect of the nickel/molybdenum ratio, and the criticality of Samples 5 and 6 having Ni:Mo ratios of 0.4 and 0.58, respectively, are within the scope of the present invention. Both samples gave a flank wear of 0.013 $in/in^3$. Samples 7, 8 and 9 having Ni:Mo ratios of about 1 or more are outside the scope of the present invention. Samples 7, 8 and 9 showed substantially increased flank wear, in the range of 0.057 to 0.087 $in/in^3$, compared to samples 5 and 6, indicating poor machinability. It is of interest to note that low flank wear (better machinability) was obtained even with the higher carbon content (samples 5 and 6) when the nickel/molybdenum ratio is 0.75 or less. In contrast, high flank wear at lower percent carbon was obtained when the nickel/molybdenum ratio equalled or exceeded 1. As will be shown in Example 3, it is possible that Samples 7 and 8, having Ni:Mo ratios of about 1, could be processed for instance by tempering, to bring them within the scope of the present invention, i.e., with flank wear less than 0.05 $in/in^3$.

EXAMPLE 3

This Example shows that the nickel/molybdenum ratio and/or percent total carbon can be increased above preferred proportions, for instance to obtain better wear with the use of more carbon, or lower cost with the use of less molybdenum, and still obtain acceptable machinability, by tempering the sintered parts. Typically, the parts are tempered at a temperature in the range of 600°–1,000° F. The following results were obtained.

TABLE 3

| | Effect of Tempering in Ni—Mo-Steel Composites | | | | | | | | | COMP. | FLANK |
|---|---|---|---|---|---|---|---|---|---|---|---|
| Sample | Ni | Mo | Ni/Mo Ratio | % C/TC | SINT °F./Atm | HTI | MR ksi | Hard RB | W500 $mm^3$ | YIELD Y700 ksi | WEAR $in/in^3$ |
| 10 | 4.5 | 4.6 | 0.98 | 0.45 | 2142N | NM | 174 | 101 | 3.6 | 101.8 | 0.057 |
| 11 | 4.5 | 4.6 | 0.98 | 0.45 | 2142N | 800N | NM | 91 | NM | 72.6 | 0.043 |
| 12 | 2.5 | 4.6 | 0.54 | 0.85 | 2125N | 1000V | 185 | 96 | 4.7 | NM | NM |
| 13 | 2.5 | 4.6 | 0.54 | 0.85 | 2142N | NM | 104 | 104 | 2.5 | NM | 0.043 |
| 14 | 2.5 | 4.6 | 0.54 | 0.85 | 2142N | 800N | 140 | 93 | NM | 87.6 | NM |
| 15 | 2.5 | 4.6 | 0.54 | 0.85 | 2125N | 600N | 132 | 98 | 4.7 | NM | 0.030 |
| 16 | 2.5 | 4.6 | 0.54 | 0.85 | 2135N | NM | 119 | 99 | NM | NM | 0.102 |
| 17 | 2.5 | 4.6 | 0.54 | 0.85 | 2135N | 800A | 161 | 100 | 4.6 | NM | 0.017 |
| 18 | 4.5 | 2.6 | 1.73 | 0.85 | 2142N | NM | 116 | 109 | 3.6 | 96.9 | 0.227 |
| 19 | 4.5 | 2.6 | 1.73 | 0.85 | 2142N | 800N | NM | 98 | NM | 74.5 | 0.070 |

TABLE 3-continued

| Sample | Ni | Mo | Ni/Mo Ratio | % C/TC | SINT °F./Atm | HTI | MR ksi | Hard RB | W500 mm³ | COMP. YIELD Y700 ksi | FLANK WEAR in/in³ |
|---|---|---|---|---|---|---|---|---|---|---|---|
| | Effect of Tempering in Ni—Mo-Steel Composites | | | | | | | | | | |
| 20 | 2.5 | 2.6 | 0.96 | 0.85 | 2142N | NM | 120 | 107 | 3.6 | 101.9 | 0.150 |
| 21 | 2.5 | 2.6 | 0.96 | 0.85 | 2142N | 800N | NM | 97 | NM | 79.0 | 0.047 |

Referring, by way of example, to samples 20 and 21, tempering at 800° F. in a nitrogen atmosphere resulted in a substantial reduction in flank wear, or improvement in machinability. A similar reduction was obtained in samples 18 and 19. The results of Table 3 show that this advantage was obtained with a wide variety of compositions within the scope of the present invention. For instance, good results were also obtained with a carbon content of 0.45 (samples 10 and 11). Sample 17, having a percent carbon of 0.85, a nickel/molybdenum ratio of 0.54, and tempered in air at 800° F., had a flank wear of 0.017 in/in³. This indicated good machinability.

EXAMPLE 4

This Example illustrates the effect of the use of pre-alloyed iron powder, compared to pure iron powder, as a base metal for the valve seat inserts. Various iron-base powders were used to prepare composition samples having 2.5% Ni, 4.5% Mo, 0.8% C, the remainder being iron. All of the samples contained less than 0.1% copper. The following Table 4 lists the samples which were tested and the base iron used in each sample.

TABLE 4

| Sample | Base Iron |
|---|---|
| 22 | Unalloyed atomized Fe powder |
| 23 | Unalloyed reduced Fe powder |
| 24 | 0.85% Mo atomized pre-alloyed Fe powder |
| 25 | 0.5 Ni—0.6 Mo atomized pre-alloyed Fe powder |
| 26 | 1.8 Ni—0.6 Mo atomized pre-alloyed Fe powder |

In each case, sufficient elemental Ni powder, elemental Mo powder and graphite was added to the base iron powder to produce a composition, containing 2.5% Ni, 4.5% Mo, 0.8% C, the remainder being iron. A molding lubricant was included in all mixes, typically about 0.6% Acrawax. All parts were molded at 50 tsi and sintered for approximately 20 minutes at about 2,100° F. in a nitrogen atmosphere. Some inserts were subsequently tempered, as noted in Tables 5 and 6, at 800° F., to improve machinability. These samples are distinguished from the non-tempered samples by the letter T.

As in Examples 1, 2 and 3, the several grades were tested for Rockwell B hardness, Modulus of Rupture, wear at 500° F., flank wear, and compressive yield at 700° F. In addition, two other evaluations, relating to flank wear, were made. "NC" gives the number of cuts which were completed before the cutting tool failed, up to 15 cuts. The test was terminated at 15 cuts. "OP" indicates the operator's opinion of the cutting operation, using the following codes:

EX = Excellent
VG = Very Good
G = Good
P = Poor
GC = Good but edge chipped
GE = Good but eroded edge
PC = Poor, edge chipped Rupture bars (1.25×0.5×0.450 inch) and rings (1,500 inch OD×1.25 inch ID) were molded at 50 tsi and processed as noted above. Properties obtained are given in the following Tables 5 and 6.

TABLE 5

| Sample | Base Fe | Sint °F./Atm | HTI | Hard RB | MR ksi | W500 mm³ | NC | OP | Flank Wear in/in³ | Comp Yield Y700 ksi |
|---|---|---|---|---|---|---|---|---|---|---|
| | Properties of Pure Fe-Base Valve Seats, Density > 7.0 G/CC | | | | | | | | | |
| 22 | Unalloyed Atomized Fe | 2120N | | 96 | 139 | 4.7 | 15 | GC | 0.027 | 69.3 |
| 22T | Unalloyed Atomized Fe | 2120N | 800A | 96 | 149 | 3.7 | 15 | VG | 0.016 | 77.2 |
| 23 | Unalloyed Reduced Fe | 2120N | | 91 | 147 | 4.2 | 15 | EX | 0.013 | 71.2 |
| 23T | Unalloyed Reduced Fe | 2120N | 800A | 93 | 149 | 4.8 | 15 | GE | 0.013 | 72.0 |

TABLE 6

| Sample | Base Fe | Sint °F./Atm | HTI | Hard RB | MR ksi | W500 mm³ | NC | OP | Flank Wear in/in³ | Comp Yield Y700 ksi |
|---|---|---|---|---|---|---|---|---|---|---|
| | Properties of Pure Fe-Base Valve Seats, Density > 7.0 G/CC | | | | | | | | | |
| 25 | .5 Ni—.6 Mo Pre-alloyed Fe | 2120N | | 104 | 134 | 3.9 | 9 | PC | 0.072 | 85.9 |
| 25T | .5 Ni—.6 Mo Pre-alloyed Fe | 2120N | 800A | 101 | 166 | 1.9 | 15 | VG | 0.0165 | 83.9 |
| 24 | .8 Mo Pre-alloyed Fe | 2120N | | 104 | 140 | 2.8 | 15 | EX | 0.036 | 91.7 |
| 24T | .8 Mo Pre-alloyed Fe | 2120N | 800A | 102 | 171 | 3.7 | 15 | GE | 0.030 | 93.7 |
| 26 | 1.8 Ni—.6 Mo Pre-alloyed Fe | 2120N | | 109 | 113 | 3.9 | 2 | PC | 0.460 | 93.2 |
| 26T | 1.8 Ni—.6 Mo Pre-alloyed Fe | 2120N | 800A | 103 | 170 | 2.3 | 12 | PC | 0.080 | 109.0 |

Samples 22 and 23 had densities ranging from 7.02 to 7.17 grams/cc. Samples 24–26 had densities ranging from 7.08 to 7.30 grams/cc. For optimum valve seat performance, it has been determined that the valve seat inserts should have the following target values.

| | Broad | Preferred |
|---|---|---|
| Modulus of Rupture | >70 ksi | >90 ksi |
| RB Hardness | >80 | >90 |
| W500° F. | <5 $mm^3$ | <4 $mm^3$ |
| Flank Wear | <0.05 $in/in^3$ | <0.025 $in/in^3$ |
| Y700° F. | >75 ksi | >80 ksi |

A review of the data of Tables 5 and 6 indicates that the pre-alloyed base compositions, samples 24, 25 and 26, gave the best results. Samples 22 and 23 showed a combination of high wear at 500° F., generally in excess of the preferred target of less than 4.0 $mm^3$, and low compressive yield at 700° F. less than 80 ksi. In contrast, alloyed base powder, met the target values on all points. Pre-alloyed based sample 25, tempered, met the target values on all points. Pre-alloyed based sample 25, non-tempered, showed high flank wear. Pre-alloyed based sample 26 also failed to meet the flank wear target, but it is anticipated that it could be made to meet this target if tempered at a higher temperature than about 800° F. The best overall results were obtained with the tempered composition of Sample 25. This sample had a density of 7.21 grams/cc. Sample 25, non-tempered, could probably be made to meet the flank wear and operator opinion targets if compounded with less carbon.

EXAMPLE 5

This Example illustrates the importance of density on the properties of the inserts. Additional inserts were made by molding samples 22 and 25 at 30 tsi instead of 50 tsi. These samples are distinguished from those in Tables 5 and 6 in the density values given under the Table heading "DEN". The results are reported in the following Table 7.

TABLE 7

| | .Properties of Unalloyed Fe-Base vs. Alloyed Fe-Base Inserts Density < 7.0 G/CC | | | | | | | | |
|---|---|---|---|---|---|---|---|---|---|
| Grade | Base Fe | Sint °F./Atm | HTI | DEN | Hard RB | MR ksi | W500 $mm^3$ | Flank Wear $in/in^3$ | Comp Yield Y600 ksi |
| 25 | .5 Ni—.6 Mo Pre-alloyed Fe | 2120N | | 6.82 | 99 | 100 | 4.7 | 0.03 | 71.9 |
| 22 | Unalloyed Reduced Fe | 2120N | | 6.92 | 89 | 107 | 5.4 | 0.0165 | 56.0 |
| 25T | .5 Ni—.6 Mo Pre-alloyed Fe | 2120N | 800A | 6.94 | 94 | 128 | *NM | 0.026 | 71.9 |
| 22T | Unalloyed Reduced Fe | 2120N | 800A | 6.91 | 89 | 104 | *NM | 0.013 | 61.2 |

At low density, all of the samples of Table 7 fell below both the broad and preferred target values for compressive yield. Samples 25 and 22, non-tempered, in Table 7, also showed higher than target wear at 500° F. The wear at 500° F., for the tempered samples 22 and 25, in Table 7, was not measured as it was felt that the wear would be about the same as the wear values obtained for the non-tempered samples. Sample 22 was also borderline with regards to RB hardness. In contrast, Sample 25, tempered, in Table 6, molded at 50 tsi, had a density of about 7.2 and was above target for wear at 500° F., compressive yield, and RB hardness. This data indicates the importance of density in obtaining satisfactory performance of the inserts. However, even at the lower density, it should be noted that pre-alloy sample 25 was superior to unalloyed sample 22.

EXAMPLE 6

This Example relates to the structure of valve inserts made in accordance with the present invention. Parts were prepared having the following composition of Table 8:

TABLE 8

| Ingredient | Percent |
|---|---|
| Ni | 2.5 |
| Mo | 4.5 |
| C | 0.8 |
| Fe | Remainder |

The iron powder was an atomized iron powder comprising 0.5% Ni and 0.6% Mo, similar to Sample 25 of Example 4. Sufficient elemental Ni powder and elemental Mo powder and carbon were added to the iron powder to achieve the above composition of Table 8.

The parts were molded at 50 TSI and sintered for approximately 20 minutes at about 2,120° F. in a nitrogen atmosphere, similar to Example 4. The parts were tempered at 800° F. A part was then sectioned, etched, and examined using a light microscope at 100 magnification. The sectioned part was also examined for hardness using a Wilson Microhardness Tester. Hardness values were measured on the Knoop scale of the Tester and then converted to Rockwell C values. The results are shown in the FIGURE. The sectioned part comprised two phases of about the same hardness so that the part had essentially a very uniform hardness throughout. The primary phase is shown in the FIGURE as a white matrix. The second phase is shown as brown etched patches dispersed in the white matrix.

The white matrix was found to have a Rockwell C hardness of about 40. The brown etched patches were actually softer and found to have a Rockwell C hardness of about 35.

Hardness measurements were also taken using the Vickers method. The brown etched patches were found to have a Vickers hardness in the range of about 345–385. The white matrix was found to have a Vickers hardness of about 380.

Areas of the white matrix and brown etched patches were analyzed using a scanning electron microscope (SEM) having an EDS x-ray spectra attachment. Both areas were found to be primarily iron. The brown patches were found to have significantly less Mo and Ni than the white matrix, in a ratio of about 1:2 or less. The parts had no hard phases or particles adverse to machinability.

It is surmised that the uniformity of the hardness throughout was due to the use of less than about 5% each of Mo and Ni, and the use of some prealloyed iron in the preparation of the inserts.

A principle advantage of the present invention is that powder metal parts having a relatively low percentage of alloying can be obtained giving excellent high temperature strength and wear and excellent machinability.

From the above description of the invention, those skilled in the art will perceive improvements, changes and modifications. Such improvements, changes and modifications within the skill of the art are intended to be covered by the appended claims.

Having described the invention, the following is claimed:

1. A valve seat insert comprising:

a tempered powder composition compacted and sintered to a density of at least about 6.8 grams per cc having a like hardness throughout;

said powder composition consisting essentially of, on a weight basis, about 0.5%-5% nickel, about 1%-5% molybdenum, less than 0.1% copper, and about 0.4%-1.2% carbon, the balance being iron;

the weight ratio of nickel to molybdenum being in the range of about 0.25:1 to 1:1.

2. The valve seat insert of claim 1 wherein said nickel and molybdenum are present in the composition before compaction and sintering as a blend of elemental nickel powder, elemental molybdenum powder, and a pre-alloyed powder in which nickel and molybdenum are pre-alloyed with iron.

3. The valve seat insert of claim 2 wherein the pre-alloyed powder comprises at least about 0.5% metal composition selected from the group consisting of nickel, molybdenum and combination thereof by weight based on the weight of the alloy.

4. The valve seat insert of claim 2 consisting essentially of about 1%-3% nickel, about 1.5%-5% molybdenum, and about 0.5%-1% carbon, the remainder being iron.

5. The valve seat insert of claim 2 compacted and sintered to a density of at least about 7 grams per cc.

6. A valve seat insert comprising:

a tempered powder composition compacted and sintered to a density of at least about 7 grams per cc and having a like hardness throughout;

said powder composition consisting essentially of, on a weight basis, about 2.5% nickel, about 4.5% molybdenum, less than 0.1% copper, and about 0.8% carbon, the remainder being iron;

said nickel and molybdenum being present before compaction and sintering as a blend of elemental nickel powder, elemental molybdenum powder, and a pre-alloyed powder in which nickel and molybdenum are pre-alloyed with iron, wherein the pre-alloyed powder comprises about 0.5% by weight nickel and 0.6% by weight molybdenum.

7. The insert of claim 6 wherein said pre-alloyed powder is atomized powder.

8. The valve seat insert of claim 1 wherein said pre-alloyed powder is atomized powder.

9. The valve seat insert of claim 1 wherein said tempered powder composition is compacted and sintered to a density of at least about 7 grams per cc.

* * * * *